US005576804A

United States Patent [19]

Hakamoto et al.

[11] Patent Number: 5,576,804

[45] Date of Patent: Nov. 19, 1996

[54] APPARATUS AND METHOD FOR INHIBITING DUST ADHERENCE TO THE CONTACT PLATE OF A COPYING MACHINE

[75] Inventors: Atsushi Hakamoto; Jyunko Mizuno; Seiichi Yamashita, all of Osaka, Japan

[73] Assignee: Mita Industrial Co., Ltd., Osaka, Japan

[21] Appl. No.: 459,800

[22] Filed: Jun. 2, 1995

[30] Foreign Application Priority Data

Jun. 8, 1994 [JP] Japan ..... 6-126144
Jun. 8, 1994 [JP] Japan ..... 6-126648
Jun. 8, 1994 [JP] Japan ..... 6-126649

[51] Int. Cl.[6] ..... G03G 15/04

[52] U.S. Cl. ..... 355/215; 355/30; 361/214

[58] Field of Search ..... 355/75, 203, 215, 355/311, 30; 361/214, 221

[56] References Cited

U.S. PATENT DOCUMENTS 4,298,279 11/1981 Yoshimura et al. ..... 361/214 X
4,837,598 6/1989 Nonami ..... 355/215 X
5,059,991 10/1991 Morisawa ..... 355/215 X
5,117,259 5/1992 Etou et al. ..... 355/203
5,298,938 3/1994 Tanabe ..... 355/30
5,398,099 3/1995 Nagamochi et al. ..... 355/215 X

*Primary Examiner*—Joan H. Pendegrass
*Assistant Examiner*—Sophia S. Chen
*Attorney, Agent, or Firm*—Sherman and Shalloway

[57] ABSTRACT

A moving optical system assembly is disposed under a contact glass for supporting a document on the upper surface of a frame of a copying machine, and comprises a moving frame 2 equipped with a source of light 4, and a document sensor arm 10 which undergoes expansion or contraction accompanying the movement of the moving frame 2, wherein a transparent electrically conducting film 20 is laminated on the upper surface of the document sensor arm 10. This assembly effectively prevents dust from adhering on the lower surface of the contact glass.

6 Claims, 2 Drawing Sheets

APPARATUS AND METHOD FOR INHIBITING DUST ADHERENCE TO THE CONTACT PLATE OF A COPYING MACHINE

BACKGROUND OF THE INVENTION

1. Field of the Invention

The present invention relates to a moving optical system assembly for exposing an image to light that is arranged under a contact glass for supporting a document on the upper surface of a frame of a copying machine.

2. Description of the Prior Art

A method of forming an image using a copying machine usually consists of placing a document on a transparent contact glass, exposing an image to light by irradiating the document with light through a contact glass while being scanned by a source of light such as halogen lamp, focusing the reflected light on a photosensitive material through an optical system such as a mirror or a lens to form an electrostatic latent image corresponding to the document image, developing the electrostatic latent image to form a toner image, and transferring the toner image onto a predetermined paper followed by fixing.

The source of light is secured to a moving frame together with the mirror which introduces the light reflected by the document into the lens, and the moving frame is moved under the lower surface of the contact glass to expose image to the light.

The moving frame is in many cases provided with an arm which contains document sensors for detecting the document size. That is, a document placed on the contact glass is automatically detected for its size, and the paper of a size corresponding to the size of the document is fed based upon the detection signal thereby to form image thereon.

In order to obtain a vivid image by the above-mentioned image formation, the surface of the contact glass on which the document is placed must be kept clean. When the surface of the contact glass is contaminated, exposure of the image to light is impaired and the image being formed is adversely affected.

In the conventional copying machines and particularly those which are equipped with a document sensor arm, there exists a problem in that dust tends to adhere to the lower surface of the contact glass. If it is the upper surface of the contact glass onto which the dust adheres, then, the surface can be easily wiped by a user without arousing any problem. However, if the lower surface of the contact glass is contaminated, it cannot be easily wiped by the user. Because of this reason, therefore, the period of maintenance is shortened arousing a new problem, and improvements have been desired.

SUMMARY OF THE INVENTION

The object of the present invention, therefore, is to prevent dust from adhering on the lower surface of the contact glass in a copying machine of the type in which an image is exposed to light by using a moving optical system assembly which is equipped with a document sensor arm.

According to the present invention, there is provided a moving optical system assembly disposed under a contact glass for supporting a document on the upper surface of a copying machine, comprising a moving frame equipped with a source of light, and a document sensor arm which is coupled to the moving frame and undergoes expansion or contraction accompanying the movement of the moving frame, the sensor arm extending, in its expanded state, over nearly the whole contact glass on the lower side thereof, wherein a transparent electrically conducting film is laminated on the upper surface of the document sensor arm.

DETAILED DESCRIPTION OF THE INVENTION

Figure 1:
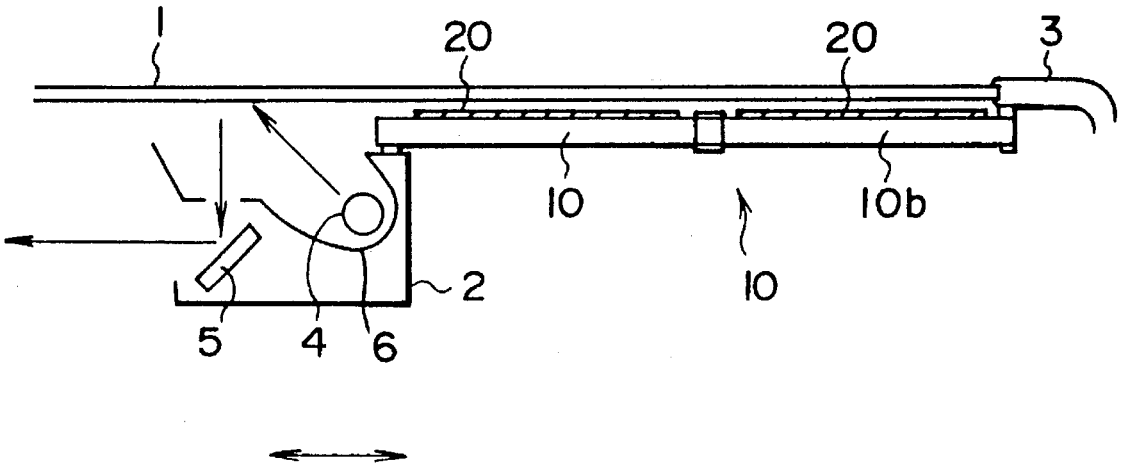
FIG. 1 is a side sectional view of a moving optical system assembly according to the present invention.

The present invention has succeeded in effectively preventing the dust from adhering onto the lower surface of the contact glass relying upon a very simple means in that a transparent electrically conducting film is formed on the upper surface of a document sensor arm that is located under the lower surface of the contact glass.

The advantage of the present invention can be understood from the following dust adhesion acceleration testing. That is, a copying machine, a blower and a fan are installed in a closed testing room measuring 2 meters×2 meters×2 meters.

Next, the power source for the copying machine is turned on, and dust consisting of the following six kinds of standard powders is sprayed in the testing room using a mixer for 10 minutes, and the blower and the fan are operated for 30 minutes.

Dust: six kinds of standard powders

| | |
|---|---|
| 7 kinds of testing dusts | 8 g |
| 8 kinds of testing dusts | 8 g |
| 10 kinds of testing dusts | 8 g |
| 11 kinds of testing dusts | 8 g |
| 12 kinds of testing dusts | 4 g |
| lycopodium spores | 2 g |

Thereafter, the blower and the fan are turned off, 200 pieces of copies of a A4 size document are consecutively obtained, and the copying machine is left to stand for another one hour. This cycle is repeated four times, and the copying machine is left to stand for 18 hours. The light transmission factor of the contact glass is measured by using a semiconductor laser (wavelength, 780 nm) and a ratio is found relative to the light transmission factor of the contact glass before the dust is sprayed.

The above-mentioned testing was conducted for a copying machine using a document sensor arm which is not provided with the transparent electrically conducting film. It was found that the transmission factor had dropped to 70 to 80% of that before the copying machine was left to stand, particularly, at a portion where the arm was located. The same testing was conducted for the copying machine using the arm equipped with the transparent electrically conducting film as contemplated by the present invention, and it was found that the transmission factor was about 90% compared with that before the copying machine was left to stand even at a portion where the arm was located, and the adhesion of dust had been effectively prevented. In order to form vivid image without adversely affecting the exposure of image to light, the transmission factor of the contact glass must be maintained to be more than about 85% relative to that of the contact glass of a clean state (i.e., relative to that of the copying machine before being left to stand).

Though the reason has not yet been clarified why the provision of the transparent electrically conducting film helps prevent the adhesion of dust to the lower surface of the contact glass, the present inventors postulate as described below.

First, the function of the document sensor arm is considered below. This arm contains a plurality of document sensors which are each constituted by a beam-generating element and a light-receiving element. The light-receiving element detects the beam that is incident on, and is reflected by, the document thereby to confirm the presence or absence of the document. That is, the sensor arm is extending over nearly the whole lower surface of the contact glass prior to exposing the image to light, and there are established combinations of sensors that detect the presence of the document and that do not detect the presence of the document. Relying upon these combinations, the document size is detected.

The beam reflected by the document must be detected by the light-receiving elements. Therefore, the document sensor arm must be brought very close to the lower surface of the contact glass. In general, the gap is set to be about 5 mm between the upper surface of the arm and the lower surface of the contact glass.

Considered below is the adhesion of dust due to the presence of the document sensor arm. The gap is very small between the arm and the contact glass. When the operation of the copying machine is discontinued, therefore, the dust particles suspended in an air stream that is mildly flowing inside the copying machine come at an increased frequency into contact with the lower surface of the contact glass as they pass between the arm and the contact glass. Besides, the copying machine uses many electrically charged members and, hence, the dust particles are mostly electrically charged as they come into collision with each other or with the electrically charged members. Therefore, if the arm has an electrostatic charge of positive polarity or negative polarity, the dust electrically charged into the same polarity is repelled and comes at an increased frequency into contact with the lower surface of the contact glass. Accordingly, the dust adheres easily.

According to the present invention, however, an electrically conducting film is provided on the upper surface of the sensor arm to completely prevent the effect of the electric charge that is present in the arm. Therefore, the electric field does not act upon the dust on the film or near the film. As a result, the dust is effectively prevented from adhering on the lower surface of the contact glass and passes through a narrow gap between the upper surface of the arm and the lower surface of the contact glass being suspended in the air stream that mildly flows inside the copying machine. (Transparent electrically conducting film)

In the present invention, it is desired that the transparent electrically conducting film provided on the document sensor arm has a surface resistance of not larger than $10^4$ Ω/□ and, particularly, not larger than $10^2$ Ω/□. When the surface resistance is larger than $10^4$ Ω/□, the effect is not satisfactory for preventing the adhesion of dust. It is desired that the transparent electrically conducting film has a transmission factor of at least not smaller than 70%. When the transmission factor is lower than 70%, it becomes difficult to detect the size of the document using document sensors.

The transparent electrically conducting film is obtained by forming a transparent electrically conducting layer on a transparent high molecular film and can be obtained in a variety of forms.

The transparent electrically conducting layer can roughly be divided into those of the inorganic type and those of the organic type. Examples of the inorganic transparent electrically conducting layer include a thin metal film comprising Au, Ag, Pd and alloys thereof; an oxide semiconductor film such as an indium oxide film (ITO) doped with Sn or a zinc oxide film doped with Al; and a composite film such as of $TiO_2$/Ag alloy/$TiO_2$, $Bi_2O_3$/Au/$Bi_2O_3$ or the like. Examples of the organic transparent electrically conducting layer include an electrically conducting high molecular film such as polypyrrole film containing $FeCl_3$, an ionic conducting film such as polyethylene oxide containing $LiClO_4$, and an inorganic/organic composite film such as of fine indium oxide powder/saturated polyester resin.

There can be exemplified a variety of transparent high molecular films that can be used as a substrate, which are, usually, polyethylene terephthalate (PET) film, polyethylene naphthalate (PEN) film, polyarylate (PAR) film, polyether sulfone (PES) film, polycarbonate (PC) film and the like.

According to the present invention, it is allowed to use any transparent electrically conducting film provided the surface resistance and the transmission factor are maintained within the above-mentioned ranges. Generally, however, an oxide semiconductor film and, particularly, the one of the ITO type is preferably used from the standpoint of durability. The film may have any thickness provided its transmission factor lies within the above-mentioned range and does not adversely affect the operation of the document sensors.

The transparent electrically conducting film can be provided on the upper surface of the arm by using a double-sided adhesive tape or the like means. When the double-sided tape has a low transparency, it is important that the portions where the document sensors are provided are not covered by the double-sided tape.

EMBODIMENTS

The invention will now be described by way of embodiments shown in the accompanying drawings.

Figure 2:
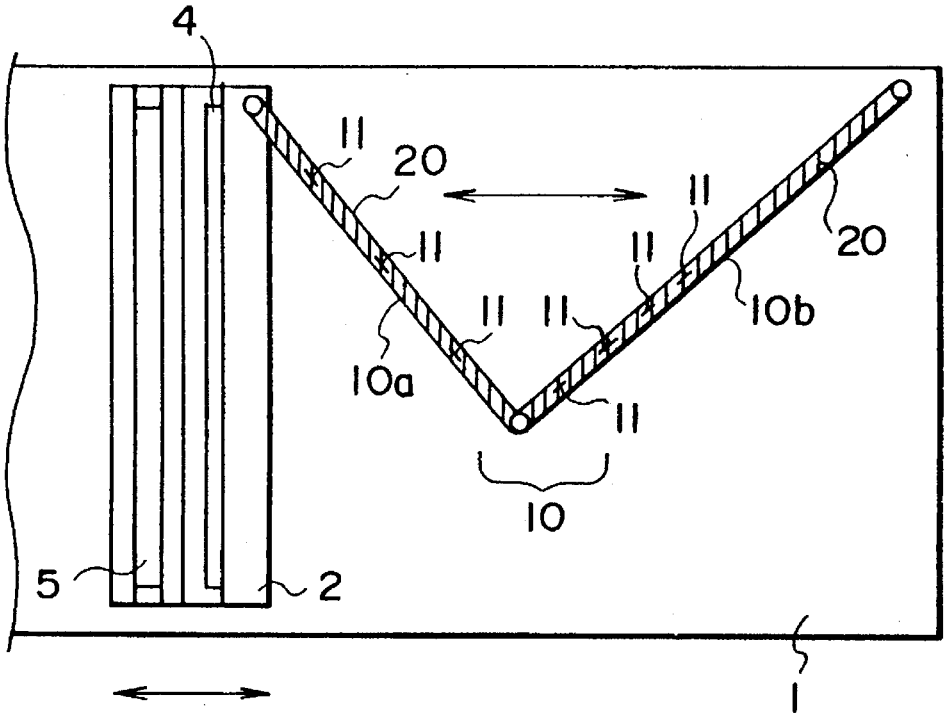
FIG. 2 is a plan view of the moving optical system assembly of FIG. 1.

Referring to FIGS. 1 and 2 which are a side sectional view and a plan view of the moving optical system assembly of the present invention, the assembly comprises a moving frame 2 and a document sensor arm 10, and is disposed under the contact glass 1 that is provided on the upper surface of the copying machine.

The moving frame 2 is slidably provided on a copying machine frame 3, and includes a source of light 4 such as halogen lamp and a mirror 5. The source of light 4 is provided in a light-shielding plate 6 having a suitable aperture, so that the light emitted from the source of light 4 and reflected by the document is incident upon the mirror 5.

That is, the moving frame 2 is moved by a suitable drive mechanism under the contact glass 1 on which the document (not shown) is placed, and whereby the light emitted from the source of light 4 and reflected by the document is further reflected by the mirror 5. The reflected light then passes through an optical system made up of other mirrors and lenses that are not shown, and is focused on the photosensitive material thereby to form an electrostatic latent image.

The document sensor arm 10 extends in a direction opposite to the direction in which the light from the source of light 4 is projected, and is constituted by a first arm 10*a* and a second arm 10*b* which are pivotally coupled together. An end of the first arm 10*a* is pivotally secured to the moving frame 2 and the second arm 10*b* is pivotally secured to the machine frame 3 so as to assume a V-shape as a whole. As will be best understood from FIG. 2, the sensor arm 10 is disposed under the surface of the contact glass 1 on which the document is placed, the first arm 10*a* contains three document sensors 11, and the second arm 10*b* contains four document sensors 11. The numbers of document sensors 11 and gaps among them in the arms may be arbitrarily selected as far as the document is reliably detected.

The gap is usually set to be about 5 mm between the upper surface of the arm 10 and the lower surface of the contact glass 1.

In the state of the home position (in which the moving frame 2 is at rest), the arm is extending over the whole lower surface of the contact glass 1. When a document is placed on the contact glass 1 and a cover (not shown) is closed, the size of the document is detected by a plurality of sensors 11 contained in the arm 10. When the moving frame 2 is moved to expose the image to light, the arm 10 also contracts or expands accompanying the movement of the moving frame 2 as shown in FIG. 2 so as not to hinder the exposure of the image to light.

According to the present invention, a transparent electrically conducting film 20 is laminated on the sensor arm 10, i.e., on the upper surfaces of the first arm 10*a* and the second arm 10*b*. This makes it possible to effectively prevent the dust from adhering on the lower surface of the contact glass 1 located on the upper side of the arm 10 at the home position.

The transparent electrically conducting film 20 (e.g., ITO film) should be provided substantially on the whole upper surfaces of the first arm 10*a* and the second arm 10*b*. If the transparent electrically conducting film 20 is provided on only a portion of the upper surfaces thereof, the dust adheres onto the portions where the film 20 is not provided to adversely affect the exposure of image to light.

Figure 3:
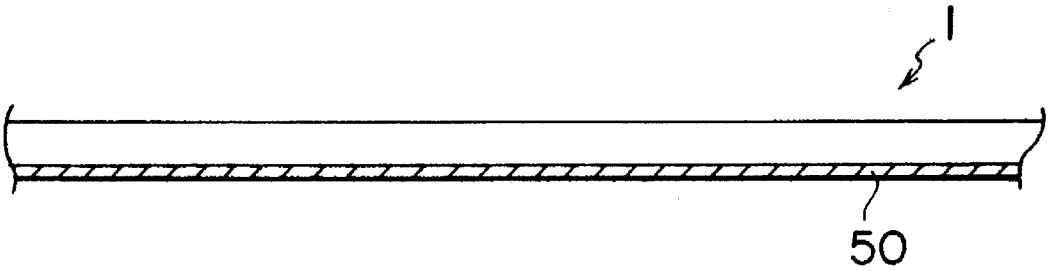
FIG. 3 is a side sectional view of a contact glass that is preferably used in the moving frame system assembly of FIG. 1.

According to the present invention, furthermore, it is desired that the transparent electrically conducting layer 50 is formed on the lower surface of the contact glass (see FIG. 3). With the transparent electrically conducting layer 50 being formed as described above, the electrically charged dust loses electric charge if it is brought into contact with the lower surface of the contact glass 1 and does not receive electric attractive force from the contact glass, either. Therefore, the dust is not held by the lower surface of the contact glass 1; i.e., the lower surface of the contact glass 1 is more effectively prevented from being contaminated by the adhesion of dust. When the dust adhesion acceleration testing same as the one mentioned earlier was carried out, it was found that the portion of the contact glass 1 located over the document sensor arm 10 maintained a transmission factor of about 100%, from which it was confirmed that the adhesion of dust was more effectively prevented.

The above-mentioned transparent electrically conducting layer 50 is easily formed by sticking the transparent electrically conducting film 20 on the lower surface of the contact glass 1. Generally, however, it is desired that the transparent electrically conducting film is formed directly on the lower surface of the contact glass 1 by vaporization or the like means.

Figure 4:
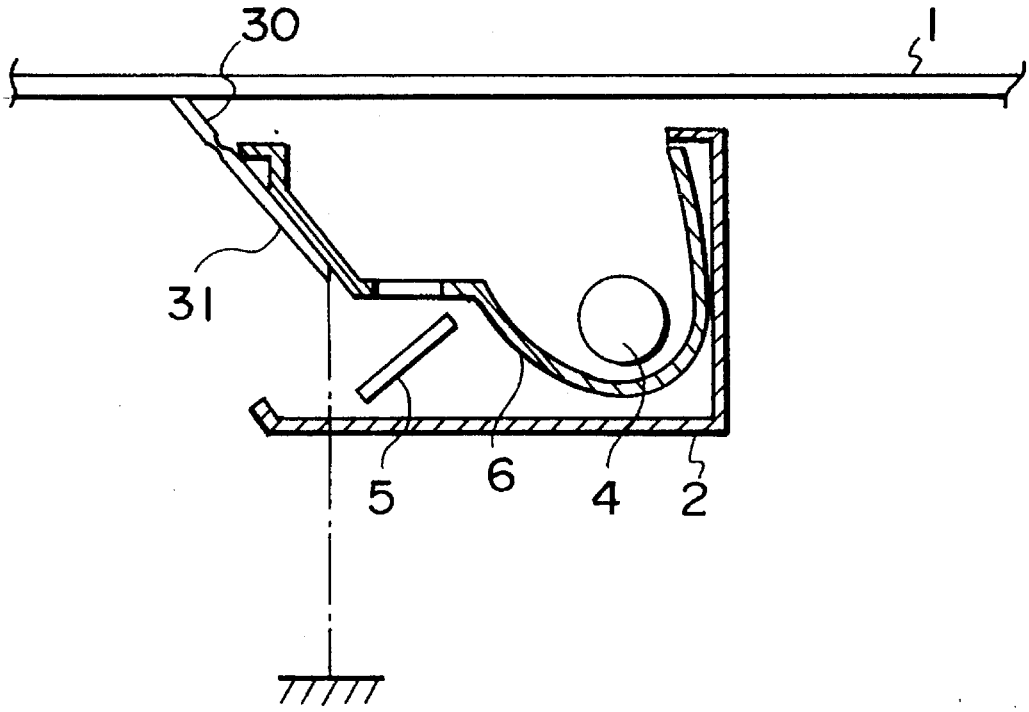
FIG. 4 is a side sectional view of a moving frame that is preferably used in the present invention.

According to the present invention as shown in FIG. 4, furthermore, the light-shielding plate 6 inside the moving frame 2 may be provided with an electrically conducting brush 30 in order to enhance the effect for preventing the adhesion of dust on the lower surface of the contact glass 1. That is, the electrically conducting brush 30 is studded on an electrically conducting substrate 31 that is secured to the outer surface of the light-shielding plate 6 so as not to hinder the path of light emitted from the source of light 4 and reflected by the document, and has its tip contacted to the lower surface of the contact glass 1. As the moving frame 2 moves to expose the image to light, therefore, the lower surface of the contact glass 1 is wiped by the electrically conducting brush 30. Furthermore, the electrically conducting substrate 31 is grounded to effectively discharge the contact glass 1.

By using the moving frame shown in FIG. 4, the contact glass 1 is effectively discharged owing to the electrically conducting brush 30 that is brought into contact with the lower surface of the contact glass, and the electrically charged dust particles are prevented from adhering on the lower surface of the contact glass that is caused by an electrostatic force. Even in case dust has adhered on the lower surface of the contact glass, the lower surface of the contact glass is wiped by the brush as the moving frame 2 moves to expose the image to light, and whereby the dust that has adhered is easily removed. Owing to the discharging action and wiping action of the electrically conducting brush, the dust is effectively prevented from adhering on the lower surface of the contact glass. When the aforementioned dust adhesion acceleration testing was carried out without providing the transparent electrically conducting film on the document sensor arm 10 but using the above-mentioned moving frame 2 equipped with the electrically conducting brush 30, the light transmission factor of the contact glass 1 as a whole was not smaller than 90%. It will therefore be understood that the adhesion of dust is more effectively prevented when the transparent electrically conducting film is formed on the document sensor arm and on the lower surface of the coontact glass.

According to the embodiment of FIG. 4, any electrically conducting metal plate or electrically conducting plastic plate can be used as the electrically conducting substrate 31.

Desirably, furthermore, the electrically conducting brush 30 is obtained by studding an electrically conducting brush made of electrically conducting organic or inorganic fibers on the substrate 31. Here, it is desired that the brush has a volume resistivity of not larger than $10^8$ Ω·cm and, particularly, not larger than $10^6$ Ω·cm. Thickness of the brush fibers, length of fibers (length of hairs) and density of studding the fibers can be suitably selected such that the contact glass is effectively discharged and wiped.

The organic electrically conducting fibers are synthetic or regenerated fibers in which electrically conducting particles are dispersed, such as polyamide fibers like nylon 6, nylon 6,6 and the like, polyester fibers like polyethylene terephthalate and the like, acrylic fibers, polyvinyl alcohol fibers, polyvinyl chloride fibers, rayon, acetate and the like. The electric conduction can be imparted to the fibers not only by the method of blending an electrically conducting agent but also by the method of metallizing the fiber surfaces. Examples of the electrically conducting agent used for imparting electric conduction include electrically conducting carbon black, metal powders such as of silver, gold, copper, brass, nickel, aluminum, stainless steel, etc., powdery electrically conducting agent such as tin oxide-type electrically conducting agents, as well as nonionic, anionic, cationic and amphoteric organic electric conducting agents and organotin-type electric conducting agents. The electrically conducting agents are blended in such amounts that the fibers exhibit the above-mentioned volume resistivity. When they are blended in too large amounts, the fibers lose flexibility though electrically conducting property may be imparted to a satisfactory degree.

Carbon fibers are preferably used as electrically conducting inorganic fibers, but metal fibers such as of a stainless steel and brass can be used as well.

According to the present invention, dust is effectively prevented from adhering on the lower surface of the contact glass which is located over the document sensor arm in a copying machine of the type in which the size of the document is detected by the document sensor arm and papers of suitable sizes are fed. Accordingly, a period of maintenance can be lengthened contributing to very enhancing practicability.

Besides, the invention can be put into practice by simply adhering by hand a transparent electrically conducting film on the document sensor arm of the existing copying machines.

We claim:

1. In a copy machine comprising:

a contact glass, having an upper surface and a lower surface, said contact glass being supportable of a document on its upper surface;

a moving optical system assembly disposed under said contact glass and spaced apart therefrom, said moving optical system assembly comprising a moving frame equipped with a source of light, and a document sensor arm, having an upper surface facing said lower surface of said contact glass, said upper surface having an area, a plurality of document sensors disposed on said upper surface of said document sensor arm, said document sensor arm coupled to said moving frame and undergoing expansion or contraction accompanying movement of said moving frame, said document sensor arm, in its expanded state, extending over nearly the whole contact glass; the improvement comprising:

a transparent electrically conducting film disposed over substantially the whole area of said upper surface of said document sensor arm, whereby dust adherence to said lower surface of said contact glass is inhibited.

2. The copy machine according to claim 1, wherein said improvement further comprises said contact glass comprising a glass plate having an upper surface and a lower surface, and a transparent electrically conducting film disposed over said lower surface of said glass plate.

3. The copy machine according to claim 1, wherein said contact glass consists of a glass plate.

4. The copy machine according to claim 1, wherein said moving frame further comprises a light-shielding plate and a reflection mirror so disposed as to receive light reflected by a document, supported on said upper surface of said contact glass, from said source of light; and said improvement further comprises an electrically conducting brush, secured to said light-shielding plate so as not to hinder the optical path from the source of light to the reflection mirror via the document and so as to bring an end of said electrically conducting brush into contact with the lower surface of said contact glass.

5. The copy machine according to claim 4, wherein said electrically conducting brush is grounded.

6. A method for inhibiting the adherence of dust to a lower surface of a contact glass in a copy machine, comprising:

providing a copy machine comprising:

a contact glass, having an upper surface and a lower surface, said contact glass being supportable of a document on its upper surface, a moving optical system assembly disposed under said contact glass and spaced apart therefrom, said moving optical system assembly comprising:

a moving frame equipped with a source of light, and a document sensor arm, having an upper surface facing said lower surface of said contact glass, said upper surfacing having an area, a plurality of document sensors disposed on said upper surface of said document sensor arm, said document sensor arm coupled to said moving frame and undergoing expansion or contraction accompanying movement of said moving frame, said document sensor arm, in its expanded state, extending over nearly the whole contact glass;

providing a transparent electrically conducting film over substantially the whole area of said upper surface of said document sensor arm, whereby dust adherence to said lower surface of said contact glass is inhibited.

* * * * *